US005669608A

United States Patent [19]

Thomson et al.

[11] Patent Number: 5,669,608

[45] Date of Patent: Sep. 23, 1997

[54] DEVICE FOR LOCATING THE POSITION OF IMPACT OF A PROJECTILE

[75] Inventors: George M. Thomson, Churchville; Thomas W. Kottke, Havre de Grace; Paul R. Berning, Perryville, all of Md.

[73] Assignee: The United States of America as represented by the Secretary of the Army, Washington, D.C.

[21] Appl. No.: 409,560

[22] Filed: Mar. 15, 1995

[51] Int. Cl.[6] ..... F41J 5/00

[52] U.S. Cl. ..... 273/373

[58] Field of Search ..... 434/16; 273/371, 273/373, 408

[56] References Cited

U.S. PATENT DOCUMENTS

| | | | |
|---|---|---|---|
| 2,629,599 | 2/1953 | Gaut | 273/373 |
| 3,112,110 | 11/1963 | Schulman | 273/373 |
| 3,398,958 | 8/1968 | Sanzare | 273/373 |
| 3,585,497 | 6/1971 | Dalzell, Jr. | 273/373 |

FOREIGN PATENT DOCUMENTS

| | | | |
|---|---|---|---|
| 298675 | 3/1992 | German Dem. Rep. | 273/371 |

OTHER PUBLICATIONS

T. Kottke and G. Thomson, "Real Time Location of Impact on a Planar Surface", Technical Report BRL-TR-3302; US Army Ballistics Research Laboratory, Aberdeen Proving Ground, MD, Dec. 1991, Unclassified.

*Primary Examiner*—Sebastiano Passaniti
*Assistant Examiner*—James Schaaf
*Attorney, Agent, or Firm*—Freda L. Krosnick; Frank J. Dynda

[57] ABSTRACT

A device for locating a position of impact of a projectile upon a planar surface of a target. The device includes a plurality of lamina-type parallel planes, fully covering the surface of the target. Each plane has at least two windings, disposed on its surface, which are arranged in zones forming a continuous conducting path. When a projectile breaks a winding, its location is rapidly sensed and reported. The pattern of wires and layers provides simple, direct compatibility of the output of the device with digital processing operations. An orthogonally situated second device locates the impact position in two dimensions and resolves possible errors in results due to the size of a projectile or a boundary hit. The device can also locate the impact of a second hit.

12 Claims, 4 Drawing Sheets

DEVICE FOR LOCATING THE POSITION OF IMPACT OF A PROJECTILE

FIELD OF THE INVENTION

The invention relates to detection devices for locating an impact, and more particularly relates to a device for locating the position of a projectile impacting a planar surface.

BACKGROUND OF THE INVENTION

Modern armored vehicles face threats from a variety of high performance projectiles. Such projectiles cannot be defeated by passive hard armors, without adding excess weight. This problem can be resolved with active directed countermeasures, i.e., systems which instantly sense the occurrence and location of an opponent's hit on the vehicle to be protected, and trigger specific steps to destroy the projectile before it can perforate the hull. In these systems, a processor must analyze the information about the location of impact quickly, preferably while the projectile is still striking the target's surface. Real time analysis of the impact requires an economical detector, which can be easily interfaced to a digital processor for analyzing the results of impact.

One solution is to construct a detector from a single plane breakwire array. The array consists of equally-spaced wires in a grid-like arrangement covering the entire surface of a target. Each wire is connected to an individual electronic circuit which changes its state when a projectile breaks a wire. According to this configuration, the broken wire instantaneously identifies the location of impact on the target surface. Although a change of state in the electronic sensor circuit is easily processed using digital signal processing techniques, the detector construction is very complex and expensive, as the number of wires increases to cover a larger target area or to prevent narrower projectiles from passing between the wires undetected.

Another possible sensor device for locating a position of impact employs distributed charge sensors. These sensors form a resistive plane covering the entire target surface. The device requires a second, conducting and electrically charged plane in close proximity with the resistive plane. During penetration of the electrically charged plane, the projectile acts as a conductor between the two planes. The charges flow from the electrically charged plane to the resistive plane via the penetrating projectile. Based on the ratios of charge accumulated on various portions of the resistive plane, a processing device determines the location of impact. In contrast to the large number of circuits used by the breakwire arrays, the distributed charge sensors require only two electronic circuits, i.e., one for each dimension, for determining a two-dimensional location of impact. In addition, the entire planar surface of the target is used without any gaps between the wires, thereby increasing impact resolution. Although manifesting important advantages over the breakwire arrays, the distributed charge sensors provide only analog signals. Digital processing of the sensor array signals requires analog-to-digital conversion entailing significant propagation delays associated with the conversion.

The above description of prior art illustrates a need for a sensor device which would determine a position of impact of a projectile without requiring complicated or excessive electrical circuitry and which easily interfaces with a digital processor.

OBJECTS OF THE INVENTION

It is therefore an object of the invention to provide a sensor device for locating a position of impact of a projectile without excessive or complicated electrical circuitry.

It is another object of the invention to provide a sensor device, which can be easily interfaced to a digital processor, for locating a position of impact of a projectile.

SUMMARY OF THE INVENTION

These and other objects, features and advantages are accomplished by a sensor device in accordance with the invention which locates a position of impact of a projectile.

The invention includes a multiplicity of parallel layers in a lamina-type arrangement, where the aligned layers fully cover the two-dimensional target surface. Each layer contains parallel windings spaced sufficiently close together to prevent the projectile from passing through a layer without breaking any windings. The parallel windings of a layer are arranged in spatial zones. Each successive layer has additional, smaller zones than the preceding layer. Thus, as the projectile passes through each of the layers, the smaller zones in each successive layer further resolve the location of impact.

The windings in each zone carry a current, which is interrupted as the projectile passes through each of the layers and breaks the wires in its path. Upon interruption of the current, an electronic current records a binary signal for display and/or further analysis, representing the condition of one winding in a layer. The digital format of the result allows easy interfacing with a general purpose computer or any digital signal processor.

In one embodiment of the invention, the first layer is divided into two zones, covered by first and second windings. The next succeeding layer includes two windings covering four zones. Adjacent zones of a layer are covered by a different winding, so that each winding covers alternate zones on the surface. In this way, the previous zones are subdivided into two regions or zones.

Likewise, succeeding layers further divide the zones of the preceding layer. In the preferred embodiment, the third layer includes eight zones, covered by two separate windings arranged so that adjacent zones are covered by a different winding.

A fourth layer includes zones which further subdivide the third layer zones. Finally, a single continuous winding is provided on a fifth layer.

Each of the layers, except the fifth layer, includes two windings, which are sensed by the circuit for continuity. Two digital registers, having a bit position corresponding to each layer, record the state of each winding of a layer for visual observation. A winding which is broken, as a result of an impact of a projectile is represented by one binary state and an unbroken winding by the alternate binary state. By presenting visually the state of each winding for each layer, it is possible to determine the point of impact of a projectile.

DESCRIPTION OF THE PREFERRED EMBODIMENTS

Figure 1:
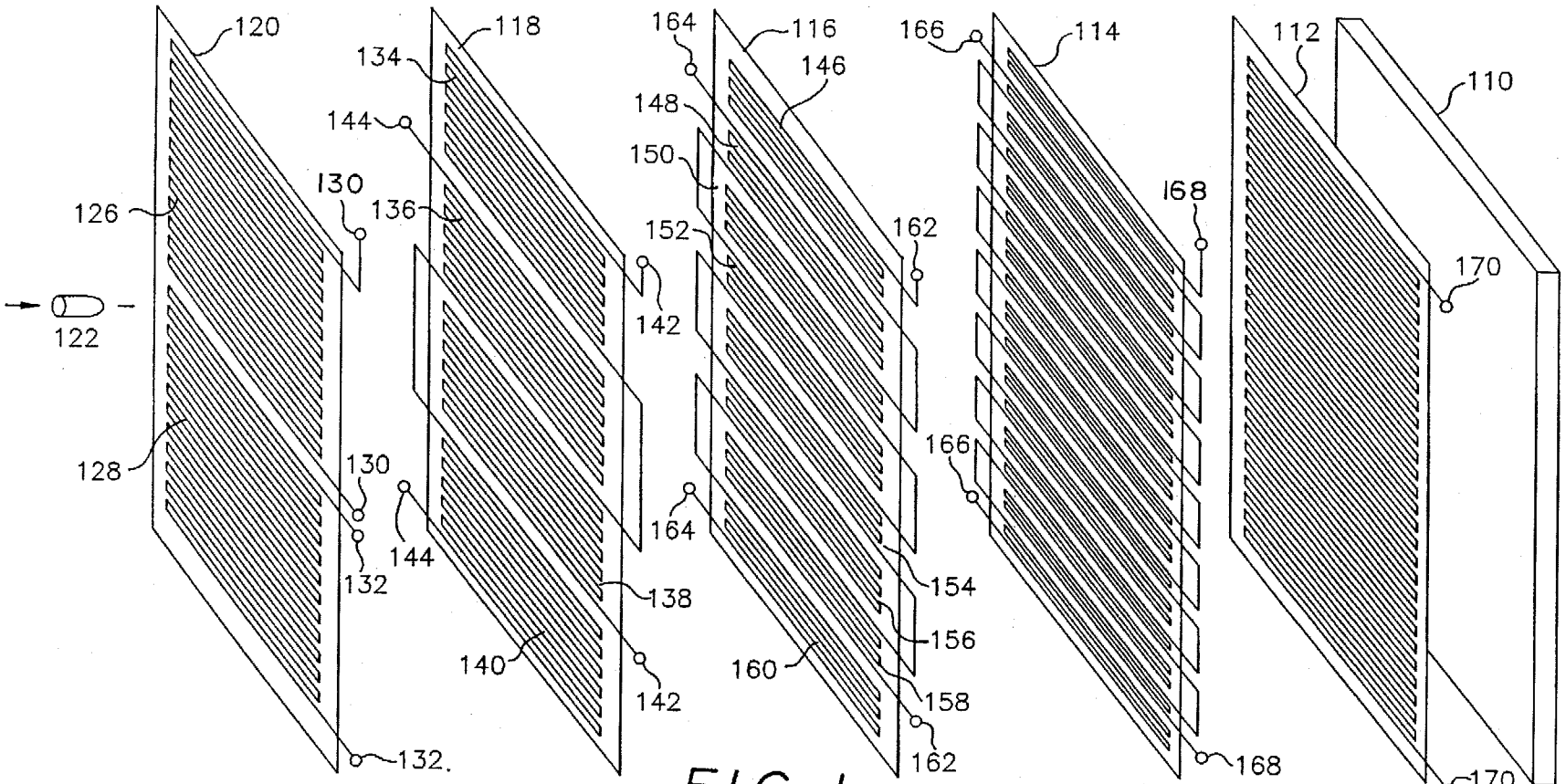
FIG. 1 is a preferred embodiment of the sensor device showing an exploded view of the layers with multiple windings arranged in zones covering the target surface.

FIG. 1 is one embodiment of the sensor device showing an exploded view of the layers with multiple windings. In FIG. 1, layers 112, 114, 116, 118 and 120 cover a target surface 110 which is impacted by a projectile 122 entering from the left of the figure. Each layer consists of a geometrical pattern of electrically conducting windings arranged in zones. As shown in FIG. 1, the first layer 120 is divided into two zones 126 and 128 in the direction which is to be position sensed. A single winding 130—130 covers zone 126 to insure that the half-plane cannot be penetrated without breaking the winding. Similarly, winding 132—132 fully covers zone 128 with the same internal spacing between the wires as in 130—130.

Further shown in FIG. 1 is the second layer 118 arranged as follows. Zone 126, occupying one-half of the target surface in layer 120, is further divided into two zones 134 and 136, and zone 128, covering the other half of the target surface in layer 120, is divided into zones 138 and 140. The winding of zone 134 is connected to the winding of zone 138 forming a single conducting path 142—142. Similarly, the windings of zones 136 and 140 form a single conducting path 144—144. Thus, adjacent zones are covered by a different winding providing for even and odd zone detection.

Continuing with the description of FIG. 1, layer 116 further divides each of zones 134, 136, 138 and 140 into two zones. Thus, zones 146 and 148 in layer 116 cover the area of zone 134 in layer 118. Similarly, zones 150 and 152 cover zone 136; zones 154 and 156 cover zone 138; and zones 158 and 160 cover zone 140. In close analogy to the arrangement in layer 118, the windings of alternating zones are connected in series with one another forming a single conducting path. Consequently, the windings from zones 146, 150, 154 and 158 are joined together forming a single conducting path 162—162. Similarly, the windings from zones 148, 152, 156 and 160 form a single conducting path 164—164, as shown in FIG. 1.

Next, layer 114 further divides each of the preceding zones into two zones, containing a total of sixteen zones. As in previous layers, a single winding is disposed over alternate zones to form two conducting paths 166—166 and 168—168.

For greater precision, one can append additional layers following the general design of the arrangement: two zones in a subsequent layer cover the area of a single zone in a previous neighboring layer, where windings of alternating zones form two conducting paths.

Further shown in FIG. 1 is the last layer 112, which is different from other layers. It contains only one winding 170—170 covering the entire surface of layer 112. The single purpose of layer 112 is to trigger processing of the information as soon as the projectile severs the winding of layer 112.

In all layers, the internal spacing of a winding is smaller than the radius of any projectile which constitutes a threat, so that the projectile hitting anywhere on the target surface must necessarily break the winding. In addition, the separation between the zones within each layer is also smaller than the radius of a projectile preventing any hits between the zones without severing the windings.

Figure 2:
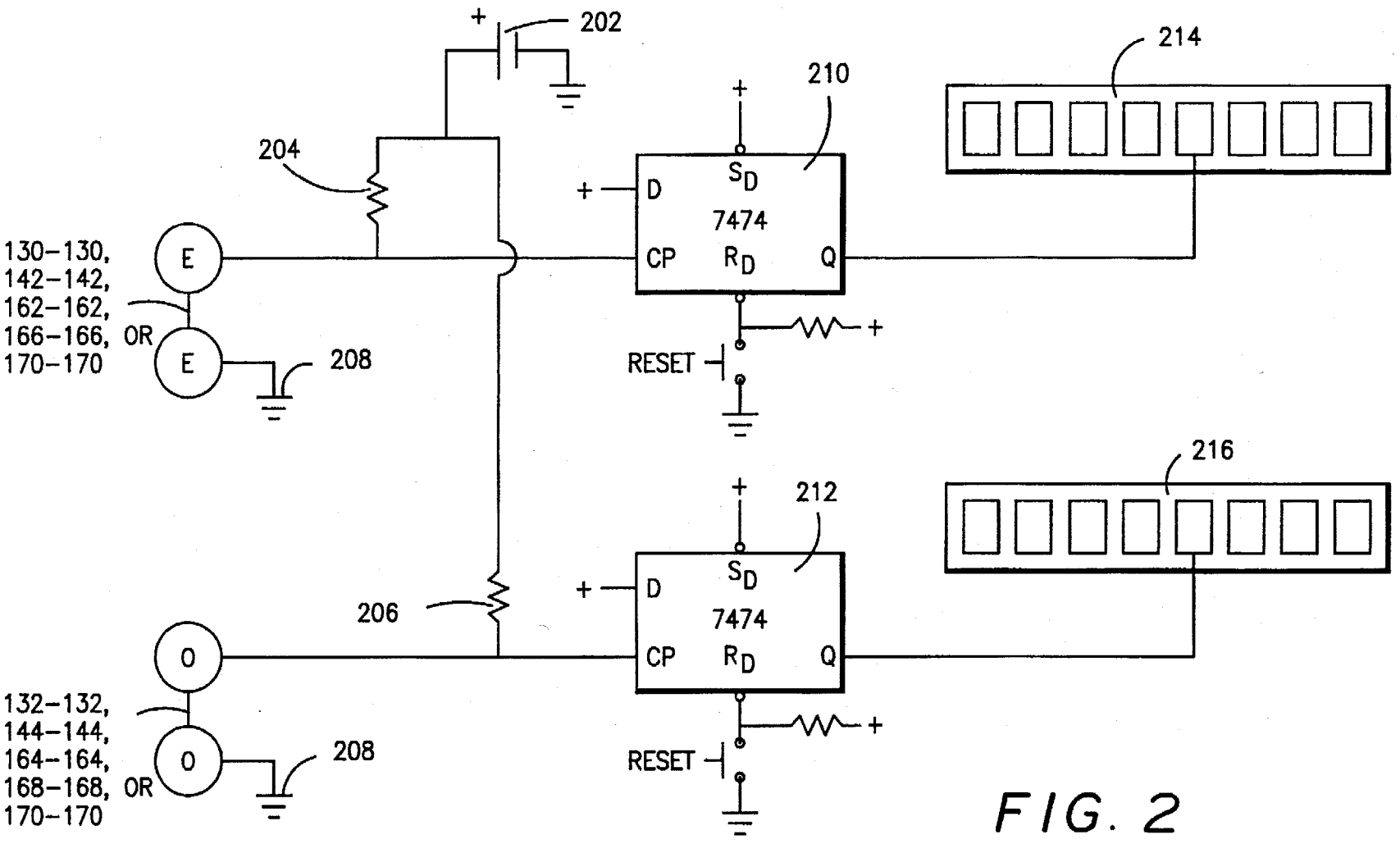
FIG. 2 is a schematic diagram of the electrical circuit of the sensor device for each layer.

Pairs of windings 130—130 and 132—132, 142—142 and 144—144, 162—162 and 164—164, 166—166 and 168—168, as well as the last winding 170—170 from the corresponding layers 120, 118, 116, 114 and 112 are connected to external electrical circuits which acquire, hold and output the results of an impact. FIG. 2 shows the electronic configuration of the sensor device for a single layer. For easier reference to the two groups of windings, windings 130—130, 142—142, 162—162 and 166—166 will be referred to as even windings, and windings 132—132, 144—144, 164—164 and 168—168 as odd windings. Single winding 170—170 belongs to both groups. References to even and odd windings do not imply any particular correspondence between the identifying numerals and the two groups of windings.

FIG. 2 is a schematic circuit diagram illustrating how the position of impact is detected in a single layer. Each winding in a layer is connected at one end to an electrical potential source 202 through resistors 204, 206 whose resistances are much greater than the resistance of the winding. The opposite ends of those windings are connected to a ground potential 208. While the winding is intact, both of its ends remain at the same potential, essentially ground. When a projectile breaks the winding, the resistor end of the winding will rise in voltage to that of the potential source 202. This signal is passed into "debouncers" or monostable multivibrator circuits 210, 212 which prevent any subsequent potential changes from appearing at its output. The specific configuration uses an integrated circuit 7474 dual D Flip-Flop with set and reset inputs to perform this task. The use of the debouncers eliminates confusion from other extraneous signals, such as flying debris, the flaying of the broken wire, or multiple making and unmaking of the circuit by the piercing projectile. As the projectile perforates the layers and breaks the windings, it changes the corresponding state of circuits 210, 212 from logical false [0] to logical true [1].

As stated earlier, the last layer contains a single winding. The last layer must always change its state, thus providing a trigger signal regardless of the impact position. Thus, the single winding is connected to both odd and even groups, setting both D Flip-Flops simultaneously at the completion of event, i.e., impact of a projectile.

Figure 3:
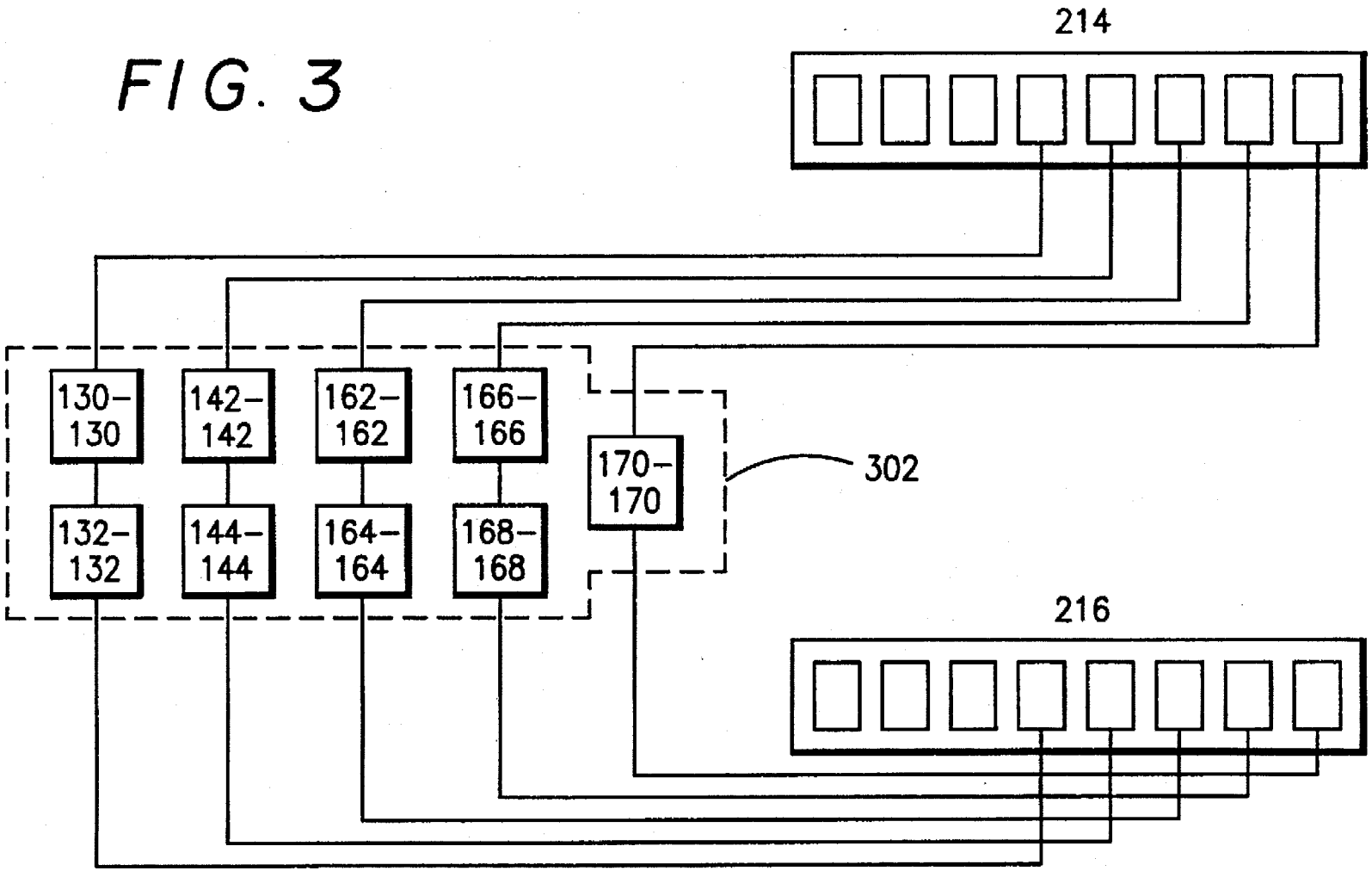
FIG. 3 is a block diagram of the preferred embodiment of the electrical circuit connected to all the layers of the sensor device.

FIG. 3. is an overall block diagram of the electrical circuits combined from all layers. The state of each pair of windings of a layer corresponds to a dedicated bit either in register 214, connected to all even windings, or register 216, connected to all odd windings. As shown in FIG. 3, each bit within these registers represents the state of a winding in a corresponding layer. A given register contains a sequence of "zeros" and "ones," starting on the left with the layer of the fewest zones, moving to the fight with the layer of the most zones and ending with the one-zone layer. The value of the left-most bits in the even register 214 is a binary representation of the impact position with the most significant bit to the left. The same bits in the odd register 216 represent the binary complement of the impact position.

Figure 4:
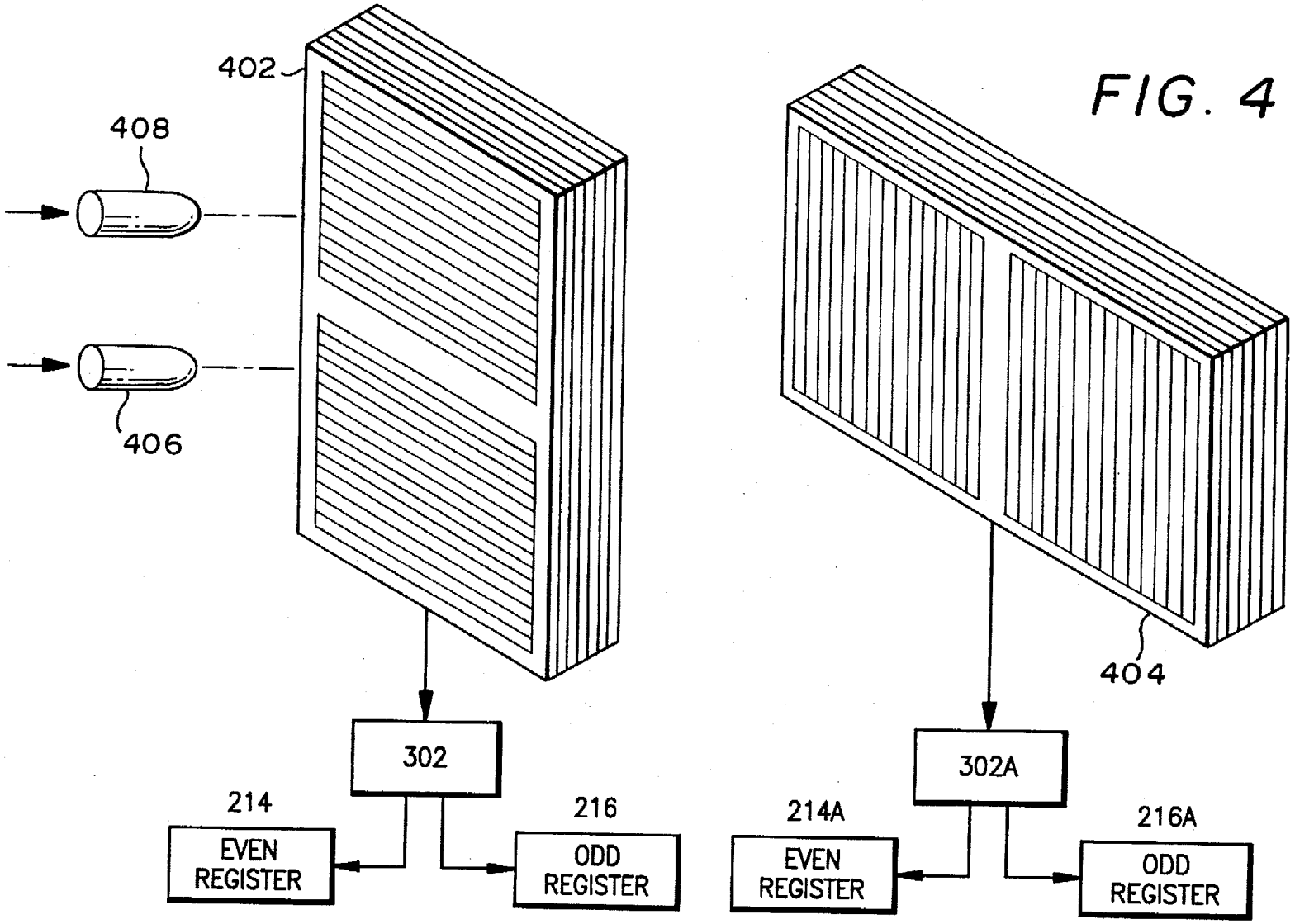
FIG. 4 is another embodiment of the invention showing two sets of orthogonally positioned layers for determining the location of impact in two dimensions and resolving complement errors.

The proper selection of the zone size guarantees that as the projectile progresses through the layers, it eventually encounters layers in which it breaks both even and odd windings. Both registers 214 and 216 will record a series of ones from all subsequent layers penetrated by the projectile. FIG. 4 shows two different situations which produce this condition called a complement error. First, the diameter of projectile 408 may be so large that it exceeds the size of a zone. In addition to severing the windings in the zone, the projectile 408 also breaks the winding in the adjacent zone within the same layer. In this case, the first occurrence of the complement error can be used to estimate the size of the projectile. The value of the binary number, displayed in the bits to the left of the error, represents the position of impact.

FIG. 4 also shows the occurrence of a second type of a complement error: the projectile 406 striking the boundary between two zones. This situation may be resolved by noting that the contents of the odd register 216, when added to the contents of the even register 214 and divided by two, yield the boundary position, and expresses it with one more binary significant figure than either of the registers 214 or 216. In the "worst" possible scenario, a projectile strikes directly in the center of the target breaking all the circuits. Both registers will be filled with set bits, indicating that penetration occurred at the bottom and at the top simultaneously. However, adding the row of ones in the even register with the 1's complement of the odd register (a row of zeros), and then dividing by two gives exactly the location of the center of the array. This procedure applies equally well to any other boundary impact. If, however, the hit does not occur at a boundary, the original value of location remains unchanged even after the above computations.

To distinguish between two types of the complement error—a projectile size and a zone boundary impact—a second set of layers 404 is added, spaced apart from the first set of layers 402 and having windings at fight angles to it, for sensing impact positions in an orthogonal direction as shown in FIG. 4. Then, the outputs from two sets of layers are processed by the electrical circuits 302 and 302A and compared using bit position in the odd and even registers. If the start of the complement error occurs in the same or nearly the same layer in both devices, then it is likely that the zone size in that layer is indicative of a projectile size. The necessity of installing an entire second device is tempered if the application requires determining impact position in two dimensions. In this case, one can mount the second device 404 normally to the first, simultaneously resolving the size/boundary hit question and giving the coordinate of the impact position in the other dimension.

Two specific examples of a complement error follow next. In the first example, a sensor is provided having eight layers divided horizontally into zones. The first layer has 2 zones, the second layer 4 zones, the third layer 8 zones, and so on, with the seventh layer having 128 zones. In accordance with this embodiment of the invention, windings in alternate zones of each layer are connected together forming two conducting paths. The last layer, number eight, provides a triggering signal for the electrical circuit and, therefore, has a single winding. After an impact, the even register 214 and the odd register 216 contain the following values:

DEVICE 1

Even register 214: 10110011

Odd register 216: 01001111

A second eight-layered sensor, with orthogonally oriented windings, is laid directly behind the first set of layers. Its corresponding registers contain the following values:

DEVICE 2

Even register 214A: 01011111

Odd register 216A: 10100011

As described above, the last layer generates the triggering signal at the completion of the event represented by the right-most, least significant bits in both registers. When the least significant bits change state, the electronic circuitry contains data representing the location of a projectile impact. For purposes of position computation, however, the right-most bit is ignored, and consequently an eight-layered device can provide 1 part in 128 precision. If the planes measure one meter in length and width, the smallest zone has a dimension which is less than 0.78 cm across.

Still referring to the specific eight-layered sensor example above, the complement error occurs in the second bit from the right in both cases. One can reasonably assume that the projectile, due to its size, interrupted the windings in one zone and the windings in the adjacent zone. The impact hole, then, is no greater than 2 zones, or 1.56 cm in diameter, on the layer with the most number of zones (128). The first seven bits in the even register 214 (1011001) and the even register 214A (0101111) give the location of the hole: the 88th zone horizontally and the 46th zone vertically on the layer with 128 zones in each set. The projectile also interrupted the 89th and 47th zones.

In the second example of the complement error, a pair of eight-layered sensors produces different results in registers 214, 216, 214A and 216A, as follows.

DEVICE 1

Even register 214: 10011111

Odd register 216: 01111111

DEVICE 2

Even register 214A: 01001011

Odd register 216A: 10110111

This situation is clearly different from the first because in sensor 402 (horizontal measurement), the complement error begins in the 4th bit from the left, while in sensor 404 (vertical measurement), it is in the seventh bit from the left. One can easily conclude that the projectile has struck at a zone boundary in device 1. Ignoring the right-most bit, the contents of the even register 214 (1001111) are added to the 1's complement of the odd register 216 (1000000), obtaining 10001111. Dividing the intermediate result by 2 yields 1000111.1, or 71½, the point where the 71st zone is adjacent to the 72nd in the seventh layer. The vertical impact position is in the 37th zone of the seventh layer, obtained from the contents of the even register 214A of sensor 404.

The present embodiment also possesses another valuable feature: second-hit capability. After the first penetration has taken place, the registers in each sensor 402, 404 contain bits reflecting the condition of zones in each layer. A second shot impacting a given layer of a sensor will either break an unbroken circuit, signaling a change in the bit for the corresponding register location, or break an already broken circuit, resulting in no change in the associated bit. A change in the bit status in either the even or the odd registers 214, 216 will indicate that the corresponding bit is different in the position of the second impact.

As an example, after a first shot, two registers in a single, eight-layered device show:

Even register 214: 10110111

Odd register 216: 01001011 and after the second shot:

Even register 214: 11110111

Odd register 216: 11011111

The location of the first shot is in the 91st zone, i.e., the decoded value of the first seven bits from the left, as shown in the even register 214 after the first shot.

To determine the location of the second shot, one must compare two sets of values in registers 214 and 216. A comparison of the even register 214 before and after the second shot shows that the second bit from the left has changed. Similar comparison with the odd register 216 reveals that the first, fourth, and sixth bits also differ after the second shot. To calculate the location of the second shot, a hypothetical even register 214' is assembled starting with the left-most, i.e., most significant, bit. Since the second shot changed the left-most bit in the odd register 216, the hypothetical even register 214' gets a zero in the left, most significant bit. Next, the second bit from the left has changed state in the even register 214, and, consequently, the hypothetical register 214' receives a one in the second from the left bit position.

Continuing with the procedure, the third bit from the left has not changed in either 214 or 216, meaning that the projectile went through the even windings. As the result, a logical one is placed in the hypothetical register 214' in the third bit position from the left. Next, the fourth bit in the odd register 216 has changed state after the second shot, indicating that the second projectile did not break the even windings, and, therefore, the hypothetical register 214' gets a logical zero. The fifth bit in the even and odd registers is unchanged, meaning that the projectile went through the odd windings, because the odd register contains a logical one. Based on this, the hypothetical register 214' receives a logical zero in the fifth position. The sixth bit in the odd register 216 became a logical one after the second shot, indicating that the second projectile went through the odd windings, and the hypothetical register 214' gets a logical zero. Next, the seventh bit position in both registers 214 and 216 contains a logical one, indicating a complement error condition. Since both even and odd windings have been broken in the seventh layer after the first impact, the seventh layer cannot provide any information for determination of the second impact location. The construction of the hypothetical register 214' must stop at this point, because the eighth layer of the sensor, which indicates the completion of the event, has also been broken after the first impact. Based on the previous six layers of the sensor, the final result shows that the second impact took place at 011000, or 24/64ths of the way across the surface.

In the preceding example, the complement error in the first shot has reduced the number of significant bits attainable in the second shot. In addition, the right-most bit, which was used to signal occurrence of the event, was disabled by the first shot. Therefore, some other provision, such as sensing a change in any other register bit, must be incorporated to signal a second hit.

The described embodiments by no means exhaust the number of possible embodiments of the inventive device. In base 2 systems, if one does not need to locate a boundary hit or a second-shot, the wire pattern covering the odd zones is superfluous. In addition, one can easily extend the present concept to cases where the position of impact on a planar surface must be expressed in non-rectilinear, e.g., polar, coordinates. Furthermore, other than base two schemes, e.g., a decimal position sensor, can be easily envisioned by following the general concept. The first layer would consist of 10 zones, each connected to a separate circuit. The second layer would be divided into 100 zones, where each zone shares a common last digit, i.e., the 3rd zone connected to the 13th, to the 23rd, etc., and so on.

The exact geometry of the sensor device can take many forms. The most significant design constraint is the numerical base B in which the result of the position must be expressed. The result can be presented in binary (B=2), octal (B=8), decimal (B=10), hexadecimal (B=16), etc. notation. The nth layer covering the surface is divided into B" equal zones in the measuring dimension. The B" zones in the nth layer, consecutively numbered 1, 2, . . . B" are then sorted into B equal categories, where the windings covering the zones in each category are electrically connected in series. The members of the first category are chosen to include the 1st, B+1st, 2B+1st . . . zones. Likewise the 2nd, B+2nd, 2B +2nd . . . and other similar sequences are also connected in series. In general, the zones to be assigned to the ith category are selected from B" zones by the relation i+(m−1)B, where m is an index ranging from 1 to n.

Although the specific embodiments of the invention have been disclosed in the particular application, the device detailed herein will equally apply to other high speed impact location applications, such as games, target range score keeping, and deployment of impact mitigation devices.

Since those skilled in the art can modify the disclosed specific embodiment without departing from the spirit of the invention, it is, therefore, intended that the claims be interpreted to cover such modifications and equivalents.

What is claimed is:

1. A device for locating a position of impact of a projectile, comprising:

a plurality of pairs of windings disposed in adjacent layers each covering parallel two dimensional surfaces, each winding of a pair of windings covering adjacent zones on a respective two dimensional surface, a first of said pairs of windings defining first and second zones in a first layer, subsequent pairs of windings further dividing said first and second zones into a plurality of smaller zones, a single winding disposed in a layer adjacent to said plurality of pairs of windings covering a common two dimensional surface, which is severed by said projectile which impacts anywhere on said parallel two dimensional surfaces, and means connected to each of said pairs of windings and to said single winding for detecting an impact of said projectile with a winding of each pair identifying a zone on said common two dimensional surface through which said projectile passes.

2. The device according to claim 1, wherein a pair of windings in a second layer adjacent said first layer divide each of said first and second zones into a plurality of alternating third and fourth zones, and wherein a pair of windings in a third layer adjacent said second layer divide each of said third and fourth alternating zones into fifth and sixth alternating zones.

3. The device according to claim 2, wherein each winding of a pair of windings is alternately spaced with a remaining winding of said pair over a parallel two dimensional surface to define said alternating zones.

4. The device according to claim 3, wherein said means includes a display device for displaying a status of each winding for each layer.

5. The device according to claim 4, wherein said means decodes said status of each winding into data indicating said position of impact for said projectile.

6. The device according to claim 5, wherein said means comprises:

an electrical potential source;

a plurality of monostable multivibrators connected in series with said electrical potential source for storing a plurality of data bits representing the current-carrying states of each winding of said plurality of pairs of windings in each layer, unchanged until said projectile severs any one of said windings of said plurality of pairs of windings; and a plurality of register means for accumulating each of said plurality of data bits from each winding of said plurality of pairs of windings in each layer.

7. A device according to claim 1, further comprising a second plurality of pairs of windings disposed in adjacent layers each covering parallel two dimensional surfaces, spaced apart from and disposed at an angle to said plurality of pairs of windings, each winding of a pair of windings covering adjacent zones on a respective two dimensional surface, a first of said pairs of windings defining first and second zones in a first layer, subsequent pairs of windings further dividing said first and second zones into a plurality of smaller zones, a second single winding disposed in a layer adjacent to said second plurality of pairs of windings covering a common two dimensional surface, which is severed by said projectile which impacts anywhere on said common two dimensional surface, and second means connected to each of said second plurality of pairs of windings and to said second single winding for detecting an impact of said projectile with a winding of each pair identifying a zone on said common two dimensional surface through which said projectile passes.

8. A method for locating a position of impact of a projectile, comprising:

providing a first plurality of parallel layers of equal area, each layer supporting a pair of windings, dividing a first layer into a first pair of adjacent zones, dividing each subsequent layer into a plurality of smaller adjacent zones within a zone of a previous layer, covering each layer with a pair of windings, a first winding of said pair of windings being disposed in alternate zones of a layer, a second winding of said pair of windings being disposed in the remaining zones of said layer, detecting the loss of continuity in each winding of said layers in response to a projectile impact, and detecting which of said adjacent and smaller adjacent zones of said layers are impacted by said projectile from said windings which are not continuous as a result of said projectile impact.

9. The method according to claim 8, wherein said detecting which of said adjacent and smaller adjacent zones of said layers are impacted, comprises:

arranging in register means bits representing states of said pairs of windings, each bit corresponding to a state of a winding of said pair of windings on each layer, and arranging in complement register means bits representing complement states of said pairs of windings, each bit corresponding to a state of the remaining winding of said pair of windings on each layer.

10. The method according to claim 9, further comprising:

providing a second plurality of layers of substantially the same two dimensional area, orthogonally disposed to said first plurality, dividing a first layer into a first pair of adjacent zones, dividing each subsequent layer into a plurality of smaller adjacent zones within a zone of a previous layer, covering each layer with a pair of windings, a first winding of said pair of windings being disposed in alternate zones of a layer, a second winding of said pair of windings being disposed in the remaining zones of said layer, detecting the loss of continuity in each winding of said layers in response to a projectile impact, and detecting which of said zones of said layers are impacted by said projectile from said windings which are not continuous as a result of said projectile impact.

11. The method according to claim 10, further comprising analyzing the location of impact in said first and second plurality of layers for differentiating between a boundary impact of a projectile and a complete erasure of a zone from the impact of the projectile.

12. The method according to claim 9, further comprising:

detecting a second loss of continuity in each winding of said first plurality of parallel layers in response to an impact from a second projectile, and determining which of said adjacent and smaller adjacent zones are impacted by said second projectile from said windings which are not continuous as a result of the impact of said second projectile.

* * * * *